US007231781B2

(12) United States Patent
Roger

(10) Patent No.: US 7,231,781 B2
(45) Date of Patent: Jun. 19, 2007

(54) JR ICE COOL FAN

(76) Inventor: Jessey Roger, 151-C25 S. Bishop Ave., Secane, PA (US) 19018

( * ) Notice: Subject to any disclaimer, the term of this patent is extended or adjusted under 35 U.S.C. 154(b) by 227 days.

(21) Appl. No.: 10/861,398

(22) Filed: Jun. 7, 2004

(65) Prior Publication Data

US 2005/0268640 A1 Dec. 8, 2005

(51) Int. Cl.
*F25D 17/06* (2006.01)

(52) U.S. Cl. ..... 62/419; 62/314; 62/411

(58) Field of Classification Search ..... 62/259.4, 62/274, 312, 314, 419, 462, 411
See application file for complete search history.

(56) References Cited

U.S. PATENT DOCUMENTS 1,433,995 A * 10/1922 Fowle ..... 415/1
4,553,430 A * 11/1985 Behrens ..... 73/170.06
4,669,304 A * 6/1987 Caragata ..... 73/170.07
5,669,758 A * 9/1997 Williamson ..... 416/4
2002/0124589 A1* 9/2002 Taylor ..... 62/380

* cited by examiner

*Primary Examiner*—Melvin Jones

(57) ABSTRACT

The present invention consists of a system directly related to air blowing fans, but JR Ice Cool Fan is designed to create water vapor in the blowout air. The complete assembly includes a rear small funnel (Zone 1), center connecting tube (Zone 2), where the water release port is situated, float assembly, large front funnel (Zone 3) and two fans. The rear fan will draw the air from the rear and force it towards Zone 2 at the same time the air will get contracted once the air passes the water release port, it will get mixed with water. Again the blowout fan in the front (Zone 3) creates a suction at Zone 2 that again creates a high velocity in Zone 2 which will draw out the water efficiently at the water release port. Once the water mixed air get into the Zone 3, it will experience expansion that will again allow the water to better mix with the air homogeneously before it is blown out. Water to air mix is adjustable; when water release screw is screwed out, the water to air will be less. If the screw is screwed in, the water to air will be more. JR Ice Cool Fan comes with face horizontal and face vertical down. This principle can be practiced on straight tubes instead of the funnels, but it won't be that efficient.

8 Claims, 6 Drawing Sheets

JR ICE COOL FAN

THE TECHNICAL OF THE INVENTION

The invention relates to fans to blow air with a little cooler and moisture.

BACKGROUND OF THE INVENTION

There are many different types of fans in the market. Normal fans draw from the back a quantity of air and blow equal amounts to the front of the fan. There are fans to blow the air through heater coils to blow hot air. There are fans to blow the air through cold cores to blow cool air.

BRIEF DESCRIPTION OF THE DRAWINGS

A more complete understanding of the present invention may be derived to detailed description and claims when considered in connection with the figures where, in like reference letters, refers to similar items throughout the figures.

(A) Release port hole
(B) Water level adjuster screw
(C) Tapered float needle
(D) Float (maintains constant level)
(E) Water transfer pipe
(F) Mixer zone
(G) Fan stand (homes fan)
(H) Small end rear fan
(I) Tank
(J) Tank lid
(K) Big end front fan
(L) Float chamber port
(M) Float chamber
(N) Connector to the pipe line

Zone (1), which is the small funnel and a small fan situated in the rear end of the funnel, helps to draw air from the rear and blows it towards the front.

Zone (2), which is the connector tube comes between the two funnels, also called the mixture zone, because the water release port is situated in the center area of the tube.

Zone (3), which is the large funnel and a large fan situated in front of the fan, blows the moisturized cool air out.

On top of the tank that carries the ice cubes, cool water or just water eventually gets transferred to the release port. For commercial purposes, the tanks may be designed differently, attached or separate, to meet its clamping convenience, but the water release system and the principles are the same.

Figure 1:
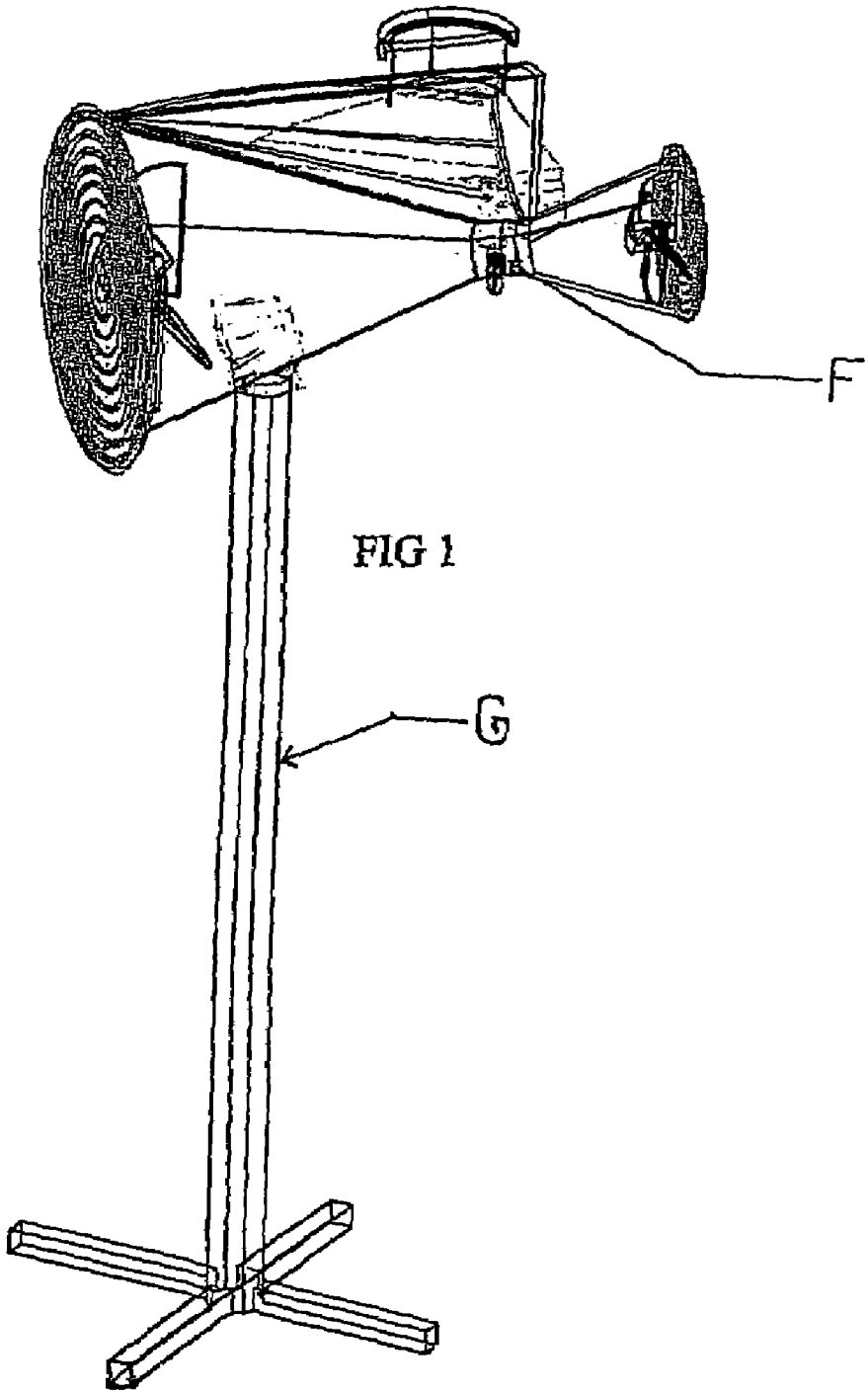
FIG. 1 shows southeast view of a three dimensional version of the home JR Ice Cool Fan where the bottom stand looks like a normal home fan, but the top fan area is different. All home fans will come with a stand; when it comes to commercial fans, normally they won't come with the stand. They will have clamping components, but the water release system and principles are the same. There may be a little modification in the outer shapes because of its clamping convenience.
Figure 2:
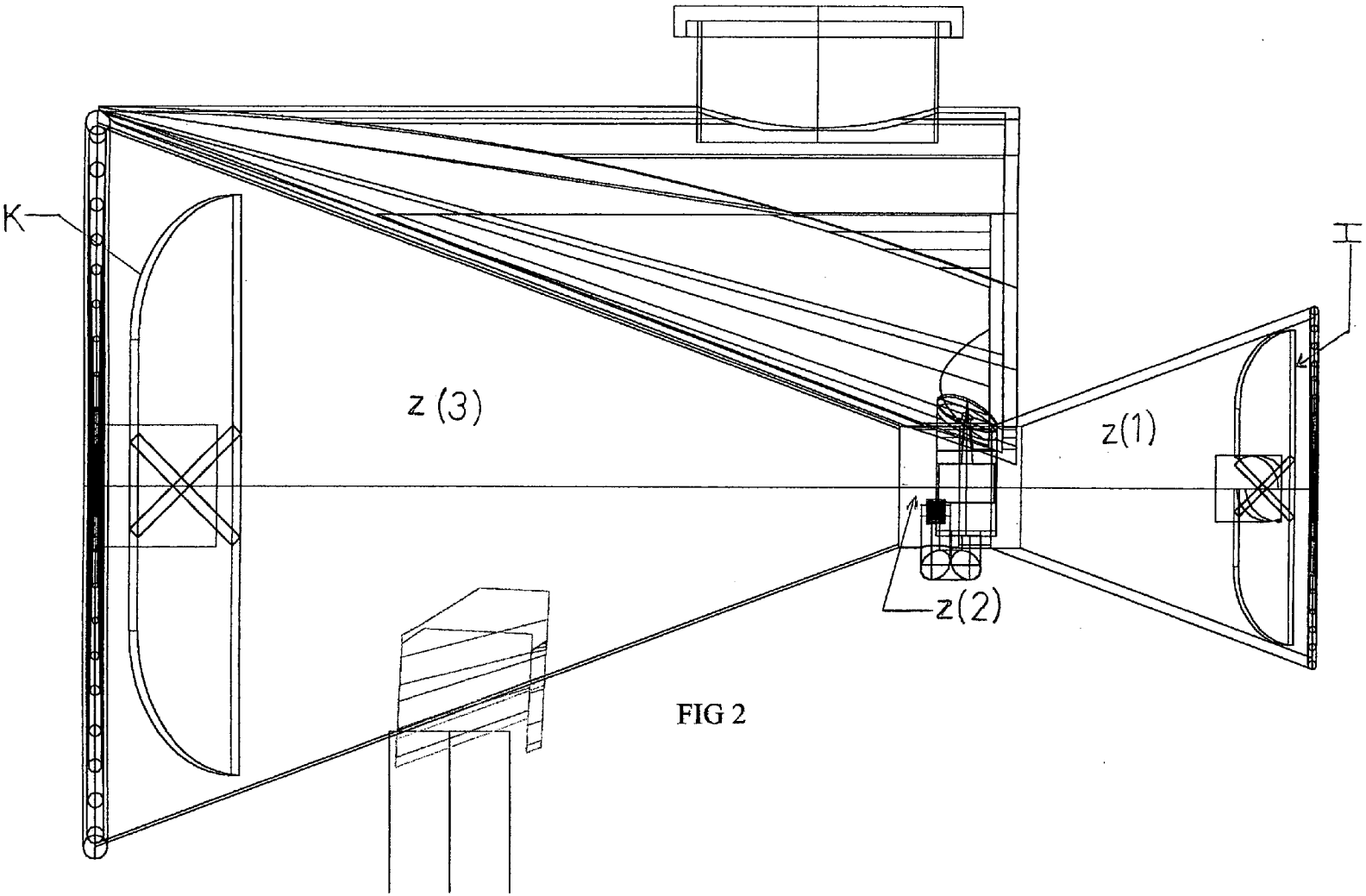
FIG. 2 right view, the right half cover was cut off to show inside all the components in detail and to show how all the components work starting from the rear.
Figure 3:
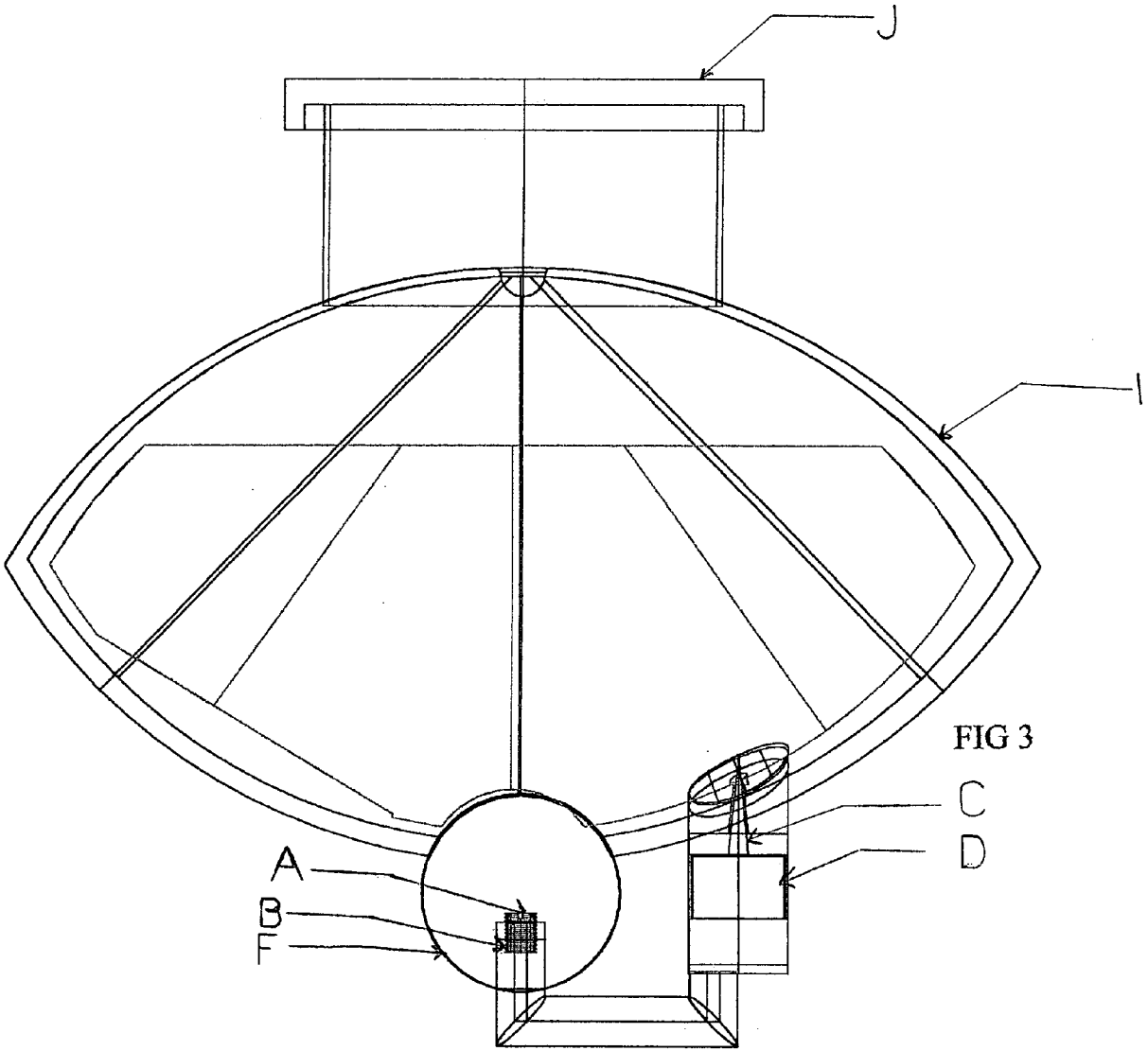

FIG. 3, rear partial view, shows the float chamber, float, float tapered needle, water entry port from tank to the float chamber, and transfer pipe that transfers the water to the water release port (A) and the adjustable water release screw (B).

JR Ice Cool Fan is engineered such a way, when the level adjuster screw (B) is adjusted to its midpoint and the water level reaches the tip of the water release port (A) in Zone (2), the float (D) will be positioned in its place where the tapered needle (C) will be a tight fit to the entry port to stop further flow from the tank into the float chamber (M). Every time the water is sucked out at the release port (A) in Zone (2), the float (D) will move down, hence the port will open and the flow will take place just to compensate the loss of water. Once the water level reaches the tip of the release port (A), automatically the float will shut down the flow of water into the float chamber (M).

Figure 4:
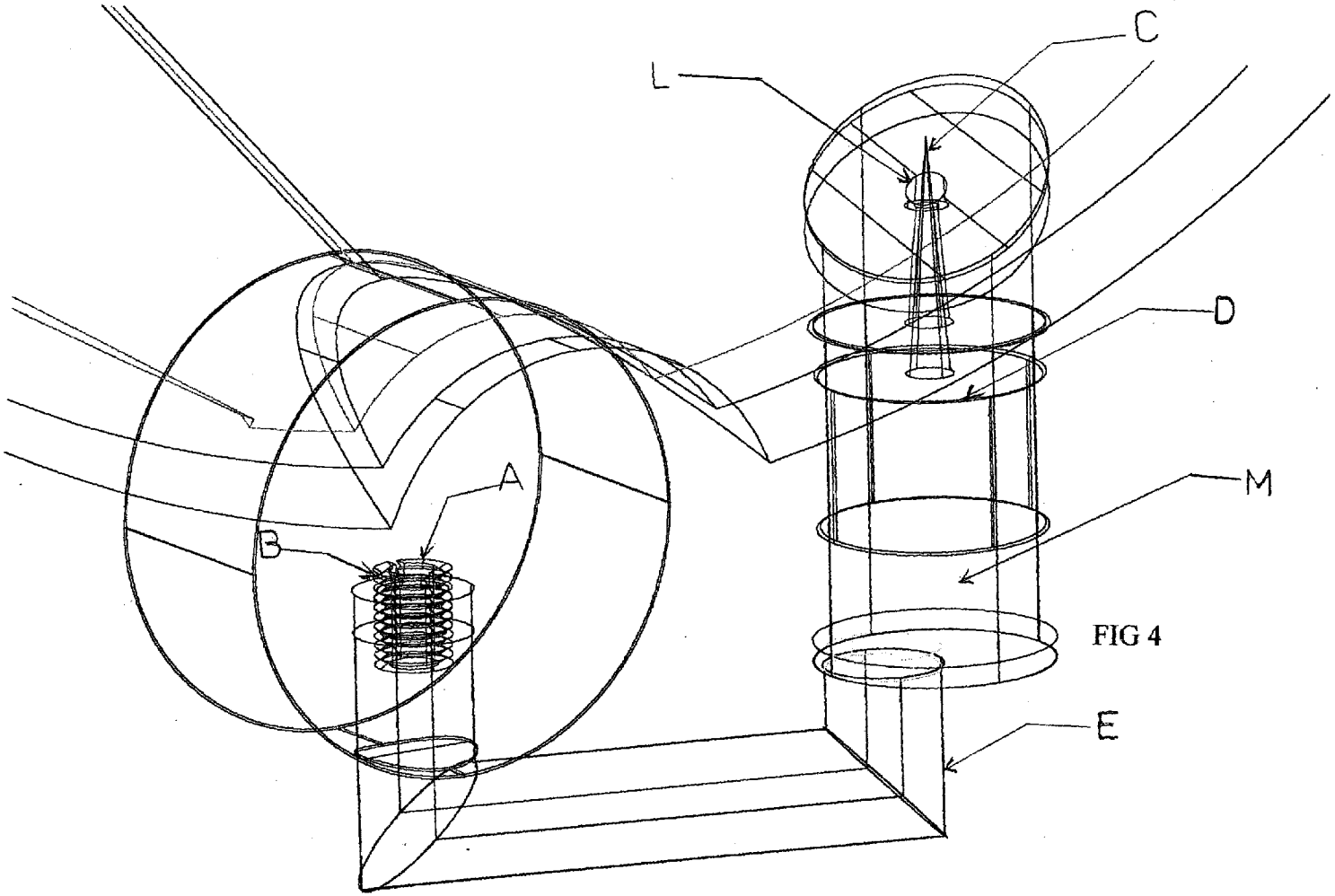

FIG. 4, rear sectional view, shows a three dimensional version of the drawing 3 of 13 looking from the rear.

Figure 5:
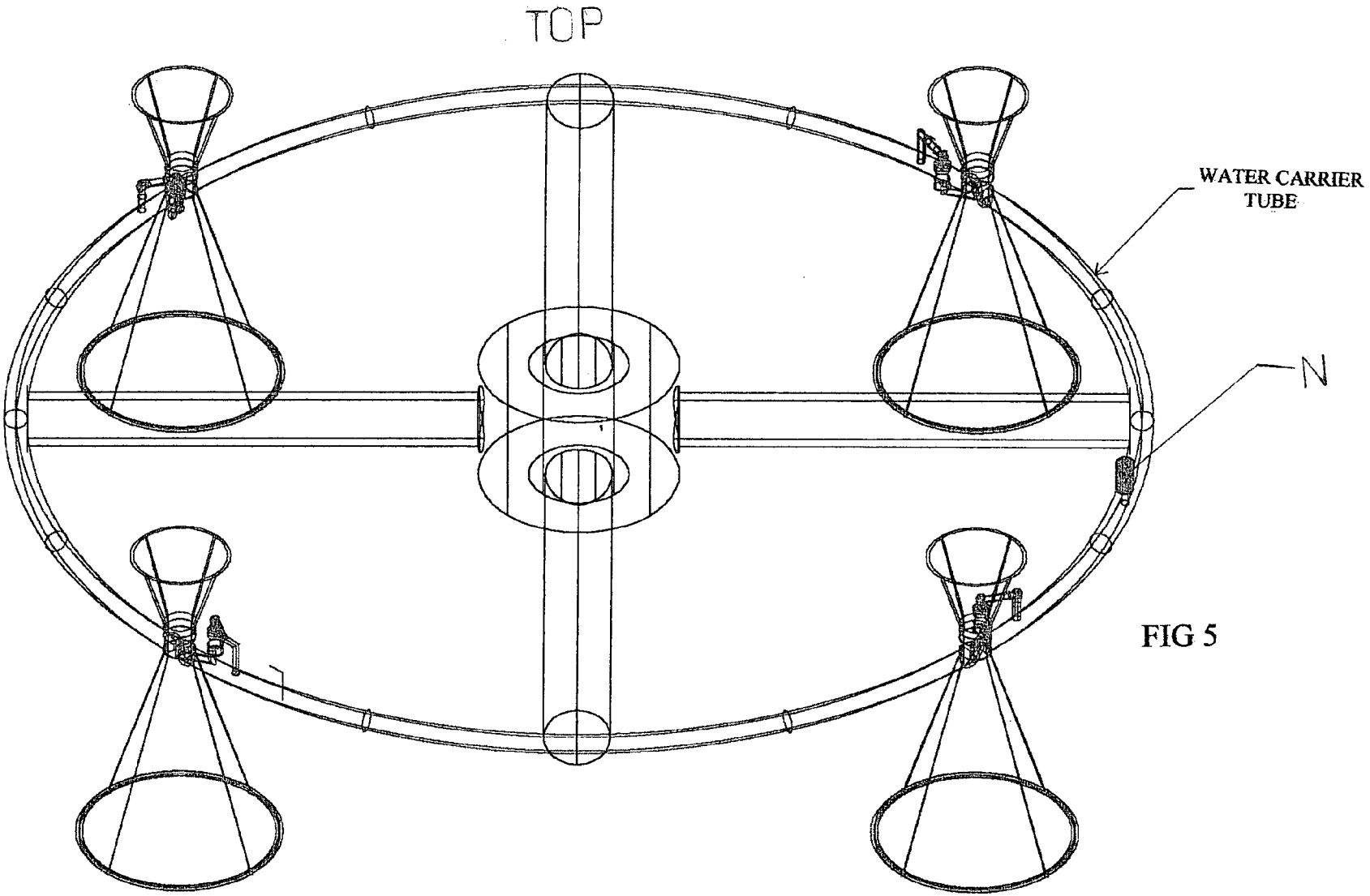

FIG. 5, southeast view, shows the JR Ice Cool Fan that is designed to be mounted on top of a ceiling fan. These designs do not come with a built-in fan. They face vertically down; once the ceiling fan is started, it will draw air from the top and blow it down at the same time. Some of the air will enter the big end of the small funnel, get contracted at the end of the Zone (1), then will travel through Zone (2), the mixture zone where the air will get moisturized, then travel down through Zone (3) where the air will experience expansion then get blown down by the ceiling fan blades.

Figure 6:
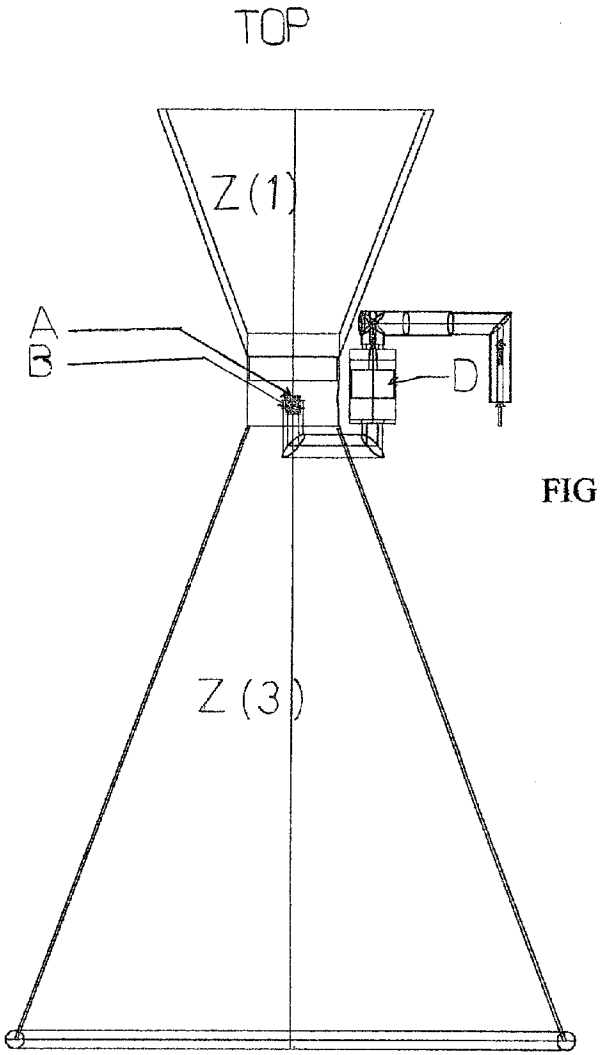

FIG. 6 right view, shows where the right half is cut off to show the modification of water release system for the vertical face down JR Ice Cool Fan. The principle of the water release system is the same.

SUMMARY OF THE INVENTION

JR Ice Cool Fan is equipped with three zone attachments: Zone (1) is the rear funnel that contracts the incoming air which is force-blown towards the Zone (2) by the rear end high speed fan. By the time the air reaches the end of the Zone (1), the temperature will rise due to the compression. Now it has to go through Zone (2) which is the mixture area, which is smaller in diameter compared to the big end of the rear funnel where the rear fan is situated; hence, this creates a high velocity at the water release port of the water moisture adjustable screw, which helps to get the water moisturized with the air that travels by. The fan in the front funnels also again helps to increase the velocity in Zone (2). This again helps the air that is traveling through Zone (2) to get moisturized efficiently at the same time to help the air to drop its temperature slightly down. Once the air leaves the Zone (2), and when it gets into the Zone (3), the air now will experience expansion. This again will help the air to drop a few degrees down in its temperature. At the same time, it creates turbulence to the air and to the water moisture and makes them a better mix homogeneously.

JR Ice Cool Fan can be practiced without the funnels which works one-to-one just like a normal fan. It may have less noise, but the moisturizing will be less efficient.

There are three models: one model comes with two fans, the other comes with one high speed fan in the large side of the funnel which is in the front. The third without the fan, but the water release system and the principles are the same.

These fans, which in the front measure from six inches in diameter to thirty-six inches in diameter, can also be even bigger. It all depends on the home need to all-commercial needs.

For home need, JR Ice Cool Fan, the tank will be filled with ice cubes. Once the ice cubes start melting, the cool water will travel through the pipe line, which is in the bottom of the tank, to the water release port, to release the cool water.

Another advantage is that the quantity of water released to the air is controllable by level adjuster screw. When the release port screw is screwed out, the water released to air will be less. When the release port screw is screwed in, the water released to air will be more.

One of the advantages for commercial purposes is that the big funnel fan can be thirty-six inches in diameter, or bigger. It can be used to moisturize a green room where plants grow, mushroom growing plants, even manufacturing plants in third world countries where they can't afford to have air conditioning. They will have large tanks attached or separate to carry hundreds of gallons of water, but the principle of the float system and the level adjuster will be the same. It may be large in size depending on how much water it has to release. Another advantage, the smaller fans of these without the stand or fan, having the big end of the big funnel vertical down, one or more can be mounted on top of the ceiling fans with the low pressure pipe line hooked onto it, hence to blow moisturized cool air.

I claim:

1. An air enhancement device comprising:

a center tube housing at least one float chamber and at least one fluid line wherein said float chamber includes a float assembly to control the amount of fluid within the float chamber delivered by said one fluid line;

at least one fluid release screw terminating the at least one fluid line for controlling the amount of fluid available to the center tube;

at least one conical tube operatively connected to the center tube at the minor end; and at least one fluid storage tank operatively connect to the center tube wherein fluid contained in the fluid storage tank flows through said at least one fluid line;

wherein the at least one float chamber includes a float assembly that controls the amount of fluid contained in the at least one fluid line.

2. The air enhancement device of claim 1, further comprising at least one blower in said at least one conical tube.

3. The air enhancement device of claim 1, wherein the fluid in the said at least one fluid line is gravity fed.

4. The air enhancement device of claim 1, wherein the fluid in the said at least one fluid line is under pressure.

5. The air enhancement device of claim 1, wherein the fluid contained in said fluid storage tank is water.

6. The air enhancement device of claim 1, further comprising a ceiling mounting apparatus.

7. The air enhancement device of claim 1, further comprising a ceiling fan adapter coupled to at least one conical tube wherein said adapter operatively connects an existing ceiling fan to said at least on conical tube.

8. The air enhancement device of claim 1, further comprising a floor stand.

* * * * *